US006123091A

United States Patent [19]

Flynn et al.

[11] Patent Number: 6,123,091

[45] **Date of Patent: *Sep. 26, 2000**

[54] PLAYYARD CANOPY

[75] Inventors: Robert C. Flynn, Naperville, Ill.; Yi M. Wang, Fremont, Calif.; Richard Glover, Greenwood, Ind.

[73] Assignee: Cosco Management, Inc., Wilmington, Del.

[ * ] Notice: This patent issued on a continued prosecution application filed under 37 CFR 1.53(d), and is subject to the twenty year patent term provisions of 35 U.S.C. 154(a)(2).

[21] Appl. No.: 08/940,909

[22] Filed: Sep. 30, 1997

[51] Int. Cl.[7] ..... E04H 15/46; A47D 7/00

[52] U.S. Cl. ..... 135/96; 135/116; 135/132; 135/143; 5/93.1; 5/97; 5/98.3; 5/414

[58] Field of Search ..... 135/96, 97, 116, 135/124, 125, 128, 132, 133, 153, 143; 5/93.1, 97, 99.1, 98.3, 414, 415; 403/397, 391

[56] References Cited

U.S. PATENT DOCUMENTS

| | | | |
|---|---|---|---|
| D. 366,978 | 2/1996 | Mariol . | |
| D. 367,788 | 3/1996 | Lawhorn . | |
| D. 370,149 | 5/1996 | Stratton . | |
| 1,289,965 | 12/1918 | Tichenor . | |
| 1,941,902 | 1/1934 | Lewis | 5/98.3 |
| 2,681,659 | 6/1954 | Hrinsin . | |
| 2,689,579 | 9/1954 | Sartori | 135/161 X |
| 2,928,405 | 3/1960 | Lawson . | |
| 2,958,084 | 11/1960 | Kenney . | |
| 3,601,825 | 8/1971 | Moorhead | 135/132 X |
| 3,656,194 | 4/1972 | Perego . | |
| 3,777,321 | 12/1973 | Hargett . | |
| 4,015,297 | 4/1977 | Christian . | |
| 4,043,349 | 8/1977 | Gays et al. | 5/97 X |
| 4,236,543 | 12/1980 | Moss . | |
| 4,694,516 | 9/1987 | Overman, Sr. et al. . | |
| 4,703,525 | 11/1987 | Shamie . | |
| 4,779,294 | 10/1988 | Miller . | |
| 4,790,340 | 12/1988 | Mahoney . | |
| 4,825,484 | 5/1989 | Riegel | 135/96 X |
| 4,945,584 | 8/1990 | LaMantia . | |
| 4,985,948 | 1/1991 | Mariol . | |
| 5,025,821 | 6/1991 | Page et al. . | |
| 5,099,866 | 3/1992 | Solis et al. . | |
| 5,161,269 | 11/1992 | McLean et al. . | |
| 5,243,718 | 9/1993 | Shamie | 5/98.3 X |
| 5,279,006 | 1/1994 | Teng . | |
| 5,286,134 | 2/1994 | Huang | 403/397 X |
| 5,379,786 | 1/1995 | Lynam . | |
| 5,517,707 | 5/1996 | LaMantia . | |
| 5,644,806 | 7/1997 | Mariol et al. | 5/93.1 X |

*Primary Examiner*—Carl D. Friedman
*Assistant Examiner*—Winne S. Yip
*Attorney, Agent, or Firm*—Barnes & Thornburg

[57] ABSTRACT

A combination playyard and canopy assembly is provided. The playyard includes a top frame having first and second side rails and first and second end rails that define an opening. The canopy includes a mounting clip, frame members, and a cover. The frame members are pivotably coupled to the mounting clip for movement about a common pivot axis and the cover is attached to the frame members. The frame members are pivotable relative to the mounting clip between a first position in which the cover extends over the opening and a second position in which the cover is moved away from the opening to allow access to the interior region of the playyard. The mounting clip includes deformable members snapped onto the top frame to mount the canopy to the top frame. The bottom perimetral edge of the cover is attached to the top frame so that the cover encompasses the entire top frame when the frame members are in the first position.

55 Claims, 5 Drawing Sheets

PLAYYARD CANOPY

BACKGROUND AND SUMMARY OF THE INVENTION

The present invention relates to playyards in which small children can be placed, and particularly to a separate playyard canopy that mounts to the top of a playyard frame to cover the playyard. More particularly, the present invention relates to a collapsible canopy for mounting on a playyard and folding between a collapsed storage configuration and an opened playyard-covering configuration.

Playyards in which small children can be placed are well known. Playyards are typically configured as cubicles having a floor panel and side panels extending upwardly therefrom to confine the child within the playyard so that the child is prevented from wandering away from the playyard. Some conventional playyards are collapsible allowing the playyard to be folded from an opened playyard configuration to a collapsed compact storage configuration. See, for example, U.S. Pat. No. 5,279,006 to Teng and U.S. Pat. No. 4,811,437 to Dillner et al.

Playyards usually have open tops so that a person attending to the child can place the child into and remove the child from the playyard easily. In addition, the side panels of conventional playyards are usually somewhat transparent so that the person attending to the child can see into the playyard to observe the activities of the child and so that the child can see out of the playyard to observe the surrounding environment. When a playyard is exposed to direct sunlight, the open top permits the sunlight to shine into the playyard potentially making the child contained in the playyard uncomfortable. The open top of the playyard also permits other objects to enter the playyard.

Playyard covers that can be attached to the playyard to cover the open top of the playyard are known. See, for example, the HAPPY CABANA™ Play Yard disclosed in the Evenflo 1995 Baby Products Catalog at page 12.

What is needed is a playyard cover that can be attached to a playyard and folded between an opened configuration covering the playyard so that sunlight is blocked from entering the playyard and a collapsed configuration allowing for access to the playyard and providing for easy storage of the playyard cover when detached from the playyard. A playyard cover that completely encloses the open top of the playyard when in the opened playyard-covering configuration to prevent insects and other objects from entering the playyard is also desired.

According to the present invention, a collapsible playyard canopy is provided for covering the top of a playyard. The canopy includes a canopy frame, a cover appended to the frame, and mounting brackets configured to releasably grip the top rail of a playyard frame and to support the canopy frame and cover in an opened configuration overlying the open top of the playyard.

In preferred embodiments, the playyard canopy includes a cloth cover that traverses the open top of the playyard. The cloth cover has an opaque top panel which extends longitudinally end-to-end across the playyard and transparent side panels that extend from the opaque top panel down to lateral sides of the playyard. The canopy frame is collapsible and supports the cloth cover of the playyard canopy above the top of the playyard when the canopy frame is unfolded to the opened configuration.

The canopy frame of the present invention includes a pair of spaced-apart mounting brackets that snap onto side rails of the playyard and a plurality of U-shaped frame members connecting the mounting brackets together. Each U-shaped frame member has a pair of side struts and a cross strut therebetween. Each side strut has an end hingedly connected to a respective mounting bracket so that the U-shaped frame members pivot about a common pivot axis. Each cross strut is received within one of a plurality of spaced-apart transversely-extending sleeves formed in the top panel of the cloth cover so that the cloth cover opens and collapses when the U-shaped frame members are opened and collapsed relative to the mounting brackets.

The U-shaped frame members can be folded together placing the canopy in a collapsed configuration having the plurality of cross struts adjacent to one another. When the canopy is in the collapsed configuration, the cloth cover is bunched together and loosely hangs between the U-shaped frame members. The U-shaped frame members can be unfolded from the collapsed configuration to an opened configuration having the U-shaped frame members generally evenly fanned out over the open top of the playyard. When the canopy is in the opened configuration, the cloth cover is pulled taut between successive U-shaped frame members.

An elastic band is attached at a bottom edge of the cloth canopy and can be stretched around the playyard perimeter adjacent to the top end rails and top side rails of the playyard. The bottom edge of the cloth canopy can encompass the playyard allowing the elastic band to contract against the sides and ends of the playyard to secure the bottom edge of the canopy firmly against the playyard. Thus, the cloth cover completely encloses the open top of the playyard. The elastic band cooperates with the cloth cover to hold the U-shaped frame members in the opened configuration fanned out over the top of the playyard.

Several embodiments of the above-described playyard canopy are contemplated. For example, one embodiment of the playyard canopy includes five U-shaped frame members hingedly coupled to one another by a single pair of spaced-apart mounting brackets. Another embodiment of the playyard canopy includes three U-shaped frame members hingedly coupled to one another by a single pair of spaced-apart mounting brackets and yet another embodiment of the playyard canopy includes only two U-shaped frame members.

A further embodiment of the playyard canopy includes two pairs of spaced-apart mounting brackets with each pair of mounting brackets being hingedly coupled to two U-shaped frame members of the canopy frame. Still another embodiment of the playyard canopy includes two pairs of spaced-apart mounting brackets with each pair of mounting brackets being hingedly coupled to only one U-shaped frame member. An additional embodiment of the playyard canopy includes a one-piece U-shaped frame member coupled to a multi-piece U-shaped frame member by a single pair of spaced-apart mounting brackets.

In addition, the length of the side struts of the canopy frame can be varied to provide for either a "tall" canopy having a portion of the cloth cover extending well above the top side rail of the playyard or a "short" canopy having the cloth cover extending only slightly above the top side rail of the playyard. If the playyard is of the folding type having a removable mattress pad with four articulated sections that can be folded around a collapsed frame of the playyard and fastened together to provide a box-like carrying structure, then the side struts of the U-shaped frame members could be limited in length so that the collapsed playyard canopy can be stored in a pouch attached to one of the articulated sections of the mattress pad.

Additional features and advantages of the invention will become apparent to those skilled in the art upon consideration of the following detailed description of preferred embodiments exemplifying the best mode of carrying out the invention as presently perceived.

BRIEF DESCRIPTION OF THE DRAWINGS

The detailed description particularly refers to the accompanying figures in which.

DETAILED DESCRIPTION OF THE DRAWINGS

Figure 1:
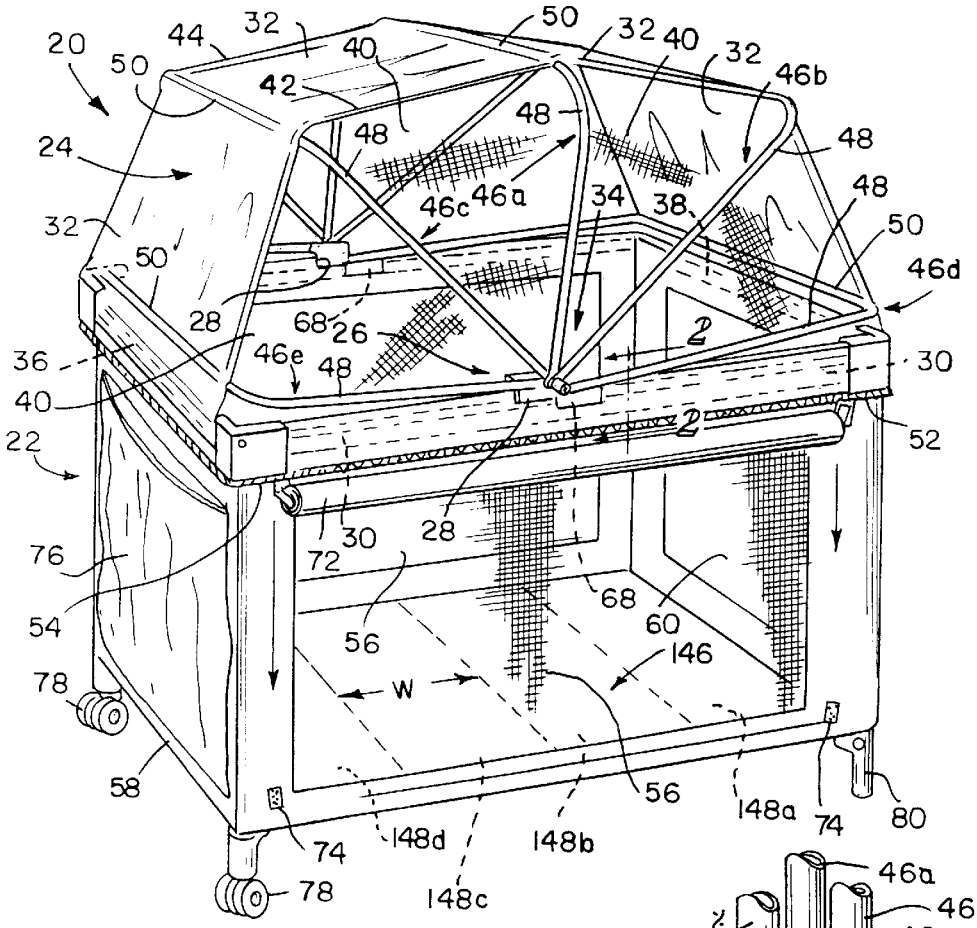
FIG. 1 is a perspective view of a first embodiment of a "tall" playyard canopy in accordance with the present invention showing the playyard canopy in an opened playyard-covering configuration mounted on the top side rails of a playyard and positioned to lie above the top opening of the playyard, the playyard canopy having a canopy frame with five U-shaped frame members hingedly coupled to a single pair of spaced-apart mounting brackets, and the U-shaped frame members fanned out over the top of the playyard to which the playyard canopy is mounted.
Figure 3:
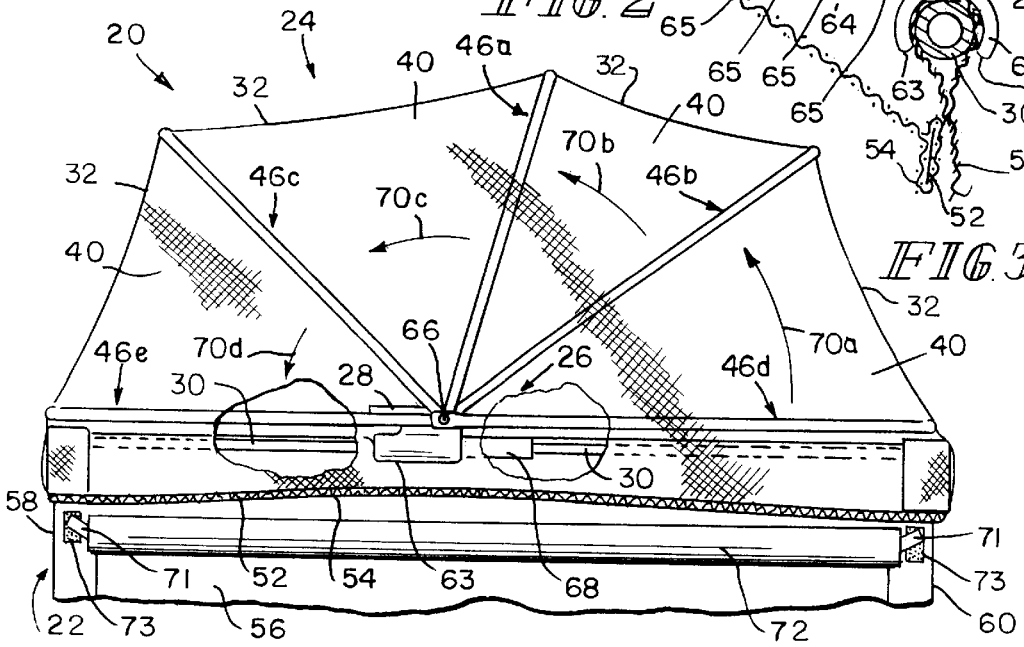
FIG. 3 is a side elevation view of the playyard canopy of FIG. 1, with portions broken away, showing one of the mounting brackets snapped onto one of the side rails of the playyard off-center and adjacent to a central latch and latch-release mechanism that connects the top side rails together, the five U-shaped frame members fanned out across the top of the playyard in a generally even arrangement, and arrows indicating that each of the U-shaped frame members is pivotable about the horizontal hinge axis toward a next successive frame member allowing the playyard canopy to be folded from the opened playyard-covering configuration (shown) to a collapsed storage configuration (not shown) while the canopy is attached to the playyard.

According to the present invention, a first embodiment of a "tall" collapsible playyard canopy 20 is provided for covering a playyard 22, as shown in FIGS. 1 and 3. Playyard canopy 20 includes a cloth cover 24 and a collapsible canopy frame 26 supporting cloth cover 24, as shown best in FIG. 1. Frame 26 of canopy 20 includes a pair of spaced-apart mounting brackets 28 that are designed to snap onto respective top side rails 30 of playyard 22 so that playyard canopy 20 can be attached to and detached from playyard 22.

Cloth cover 24 includes a top panel 32 that is positioned to lie above an open top 34 of playyard 22 and that extends longitudinally between first and second top end rails 36, 38 of playyard 22 when playyard canopy 20 is in an opened playyard-covering configuration, as shown in FIGS. 1 and 3. Cloth cover 24 also includes two side panels 40 which extend downwardly from first and second side edges 42, 44 of top panel 32 to lateral side panels 56 of playyard 22, as shown in FIG. 1.

Top panel 32 of cloth cover 24 is made from an opaque solid material so that sunlight and other objects are blocked by top panel 32 from entering playyard 22. In addition, side panels 40 of cloth cover 24 are made from a generally transparent netting material so that a person attending to a child which is placed in playyard 22 can see into playyard 22 to observe the activities of the child and so that the child can see out of playyard 22 to observe the surrounding environment. The netting material of side panels 40 also prevents bugs and other objects from entering playyard 22.

Canopy frame 26 of playyard canopy 20 includes five U-shaped frame members 46*a*, 46*b*, 46*c*, 46*d*, 46*e* connecting mounting brackets 28 together, as shown in FIG. 1. Each of the five U-shaped frame members 46–*e* has a pair of spaced-apart side struts 48 and a cross strut 50 extending transversely therebetween. Each side strut 48 has an end hingedly connected to one of respective mounting brackets 28 for pivoting movement about a common horizontal hinge axis 66. Top panel 32 includes five spaced-apart transversely-extending sleeves (not shown) and cross strut 50 of each of frame members 46–*e* is received within a corresponding sleeve so that each U-shaped frame member 46*a*–*e* is connected to top panel 32.

When canopy 20 is in the opened playyard-covering configuration, frame member 46*a* extends generally vertically upwardly from mounting brackets 28, frame members 46*d*, 46*e* extend generally horizontally from mounting brackets 28 adjacent to side rails 30 and respective first and second end rails 36, 38 of playyard 22, and frame members 46*b*, 46*c* extend from mounting brackets 28 between frame member 46*a* and respective frame members 46*d*, 46*e*, as shown in FIGS. 1 and 3. Thus, U-shaped frame members 46*a*–*e* are generally evenly fanned out from mounting brackets 28 across open top 34 of playyard 22. In addition, cloth cover 24 is pulled taut between successive U-shaped frame members 46*a*–*e* when canopy 20 is in the opened playyard-covering configuration.

Figure 2:
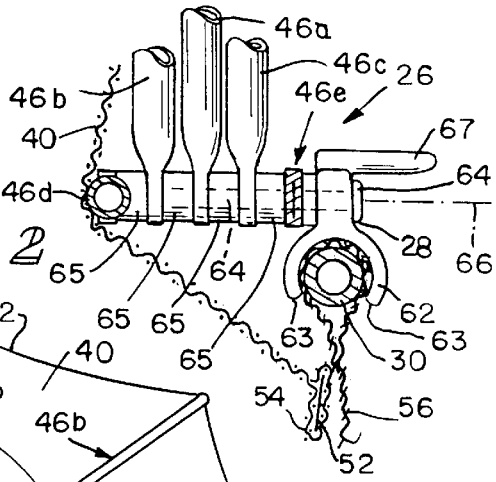
FIG. 2 is a cross-sectional view of one of the mounting brackets of the playyard canopy taken along line 2—2 of FIG. 1 showing the mounting bracket snapped onto a side rail of the playyard, a horizontal hinge pin extending outwardly from the mounting bracket, an end of each of the five U-shaped frame members mounted on the hinge pin for pivoting movement about a transverse horizontal hinge axis, and spacers mounted on the hinge pin between the ends of each of the U-shaped frame members.

An elastic band 52 is attached to a bottom edge 54 of cloth cover 24, as shown in FIGS. 1–3. Elastic band 52 can be stretched around the perimeter of playyard 22 adjacent to and below first and second top end rails 36, 38 and adjacent to and below top side rails 30 of playyard 22. Bottom edge 54 of cloth cover 24 can encompass playyard 22 so that elastic band 52 can contract against side panels 56 and against first and second end panels 58, 60 of playyard 22 to firmly secure bottom edge 54 of cloth cover 24 firmly against playyard 22. Thus, cloth cover 24 completely encloses open top 34 of playyard 22. Elastic band 52 cooperates with cloth cover 24 to hold U-shaped frame members 46*a*–*e* in the opened playyard-covering configuration fanned out over open top 34 of playyard 22.

Figure 17:
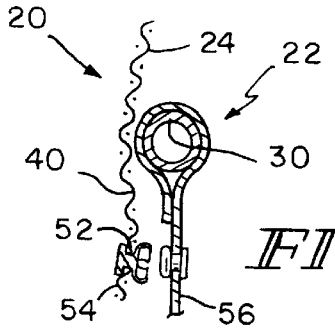
FIG. 17 is a sectional view similar to FIG. 2 showing the playyard and canopy cover including a snap connector used to fix the cover to the playyard.
Figure 18:
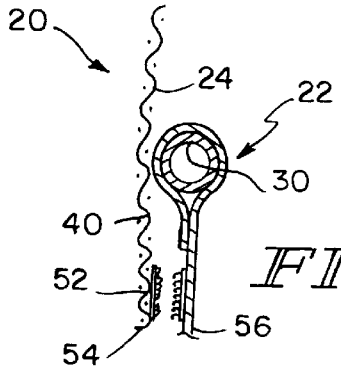
FIG. 18 is a sectional view similar to FIG. 17 showing the playyard and canopy cover having hook and loop fastener strips used to fix the cover to the playyard.

In other embodiments, band 52 can be provided with snap connectors for connecting band 52 to playyard 22 to fix cover 24 in place on playyard 22 as shown in FIG. 17. Alternatively, band 52 can be provided with hook and loop fastener strips that attach to corresponding hook and loop fastener strips mounted on playyard 22 as shown in FIG. 18. Cover 24 could be provided without elastic band 52 and could instead rely solely on either hook and loop fastener strips or a plurality of snap connectors to fix cover 24 in place on playyard 22. In addition, cover 24 could be provided with a combination of snap connectors and hook and loop fastener strips to achieve the same result.

Each mounting bracket 28 of canopy frame 26 is formed to include a pair of downwardly extending curved flanges 62, as shown in FIG. 2. Curved flanges 62 have bottom edges 63 that elastically deform outwardly away from one another when canopy 20 is mounted to top side rails 30 of playyard 22 allowing mounting brackets 28 to snap over side rails 30. After mounting brackets 28 are snapped over side rails 30, bottom edges 63 return inwardly so that curved flanges 62 snugly grip side rails 30 to firmly hold canopy 20 onto playyard 22. Each mounting bracket 28 also includes a plate 67 which can be engaged to snap mounting bracket 28 onto and off of side rails 30 of playyard 22.

A horizontal hinge pin 64 extends outwardly from each mounting bracket 28 above curved flanges 62 and the ends of each side strut 48 of the five U-shaped frame members 46*a*–*e* are coupled to one of respective hinge pins 64. Hinge pins 64 of mounting brackets 28 are aligned to define common hinge axis 66 about which all of U-shaped frame members 46*a*–*e* pivot. The ends of each side strut 48 that couple to respective hinge pins 64 are flattened and spacers 65 are mounted on each hinge pin 64 between the flattened ends of each side strut 48, as shown in FIG. 2. Hinge pins 64 cooperate with U-shaped frame members 46*a*–*e* to allow canopy 20 to fold between the opened playyard-covering configuration and the collapsed storage configuration while canopy 20 is mounted to playyard 22.

Figure 16:
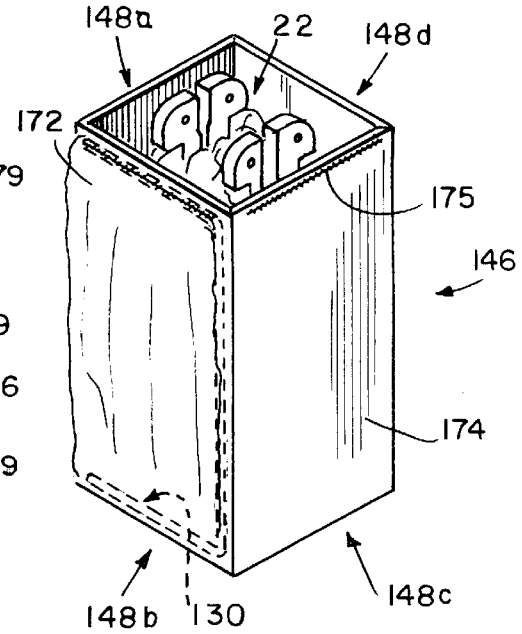
FIG. 16 is a perspective view of the collapsed playyard and mattress pad of FIG. 15 showing the mattress pad folded around the collapsed playyard and fastened together to provide a box-like carrying structure for carrying the playyard and playyard canopy.

Playyard 22 is a folding playyard that can collapse from an opened playyard configuration, shown in FIG. 1, to a collapsed storage configuration, shown in FIG. 16, after playyard canopy 20 has been detached from playyard 22. Playyard 22 includes a side rail latch and latch-release mechanism 68 that allows side rails 30 on each side of playyard 20 to be folded between an in-line position, shown in FIGS. 1 and 3, and a side-by-side position (not shown). Latch and latch-release mechanism 68 is centrally located between first and second end rails 36, 38, as shown in FIGS. 1 and 3 (in phantom).

In order to mount playyard canopy 20 onto playyard 22, mounting brackets 28 are snapped onto side rails 30 of playyard 22 off-center and adjacent to a respective latch and latch-release mechanism 68, as shown in FIGS. 1 and 3. Each of U-shaped frame members 46*a–e* are sized slightly differently to compensate for the off-center mounting of mounting brackets 28 so that cloth cover 24 assumes a generally symmetrical shape when playyard canopy 20 is in the opened playyard-covering configuration covering open top 34 of playyard 22.

Each U-shaped frame member 46*a–e* is pivotable about horizontal hinge axis 66 toward a next successive frame member in the direction indicated by arrows 70*a,* 70*b,* 70*c,* 70*d,* shown in FIG. 3, allowing playyard canopy 20 to be folded from the opened playyard-covering configuration to a collapsed storage configuration. For example, frame member 46*d* can pivot in direction 70*a* into contact with frame member 46*b,* frame members 46*b,* 46*d* can then pivot together in direction 70*b* into contact with frame member 46*a,* frame members 46*a,* 46*b,* 46*d* can then pivot together in direction 70*c* into contact with frame member 46*c,* and finally, frame members 46*a–d* can then pivot together in direction 70*d* into contact with frame member 46*e.* When playyard canopy 20 is in the collapsed storage configuration, cross struts 50 and side struts 48 of frame members 46*a–e* are adjacent to one another and cloth cover 24 is bunched together and loosely hangs between U-shaped frame members 46*a–e.*

Thus, when playyard canopy 20 is mounted onto playyard 22, playyard canopy 20 can be folded from the opened playyard-covering configuration to the collapsed storage configuration allowing the child attendant to have access to playyard 22 so that the child can be placed into or removed from playyard 22 through open top 34. After the child has been placed into playyard 22, the child attendant can then unfold playyard canopy 20 from the collapsed storage configuration back to the opened playyard-covering configuration to cover playyard 22 and shield the child from sunlight and other objects. Alternatively, the child attendant can easily detach playyard canopy 20 from playyard 22 while playyard canopy 20 is in the collapsed storage configuration. After being detached from playyard 22, playyard canopy 20 can be compactly stored in the collapsed storage configuration.

A separately attachable roll-down side wall 72 is provided for blocking sunlight from entering playyard 22 through side panels 56. Roll-down side wall 72 includes a pair of spaced-apart tabs 71 that fasten to corresponding hook and loop fastener pads 73 which are affixed to top corner portions of side panels 56 adjacent to side rails 30 so that roll-down side wall 72 can be mounted to playyard 22, as shown best in FIG. 3. Side panels 56 of playyard 22 are made from a netting material and when roll-down side wall 72 is unrolled to cover up the netting material of a selected side panel 56, roll-down side wall blocks sunlight from entering playyard 20 through the netting material of the covered side panel 56.

A pair of hook and loop fastener pads 74 are attached to bottom corner portions of side walls 56 and roll-down side wall 72 has a pair of tabs (not shown) which fasten to respective pads 74 to hold roll-down side wall 72 in place when unrolled. In one embodiment, a spring return mechanism (not shown) is provided for returning roll-down side wall 72 to its rolled up position, shown in FIGS. 1 and 3, automatically once the tabs are disengaged from pads 74.

Illustrative playyard 22 also includes an end pocket 76 mounted below first end rail 36, as shown in FIG. 1. Pocket 76 can be used to store objects (not shown). In addition, illustrative playyard 22 includes a pair of casters 78 mounted to a bottom frame (not shown) below end pocket 76, as shown in FIG. 1. Casters 78 allow playyard 22 to be rolled along the ground surface on which playyard 22 sets when the non-castered end of playyard 22 is lifted out of contact with the ground surface. Ground feet 80 are mounted to the bottom frame below second end rail 38. Ground feet 80 prevent playyard 22 from inadvertently rolling when ground feet 80 are in contact with the ground surface.

Although playyard 22 is a folding playyard having casters 78, ground feet 80, end pocket 76, and roll-down side wall 72, it is within the scope of the invention as presently perceived for playyard canopy 20 to be used with many types of playyards having typical length and width including those that do not fold and those without casters 78, ground feet 80, end pocket 76, and roll-down side wall 72. It is also within the scope of the invention as presently perceived for playyard canopy 20 to have other types of canopy frames and other types of cloth covers. Some variations of playyard canopy 20 are described below.

Figure 4:
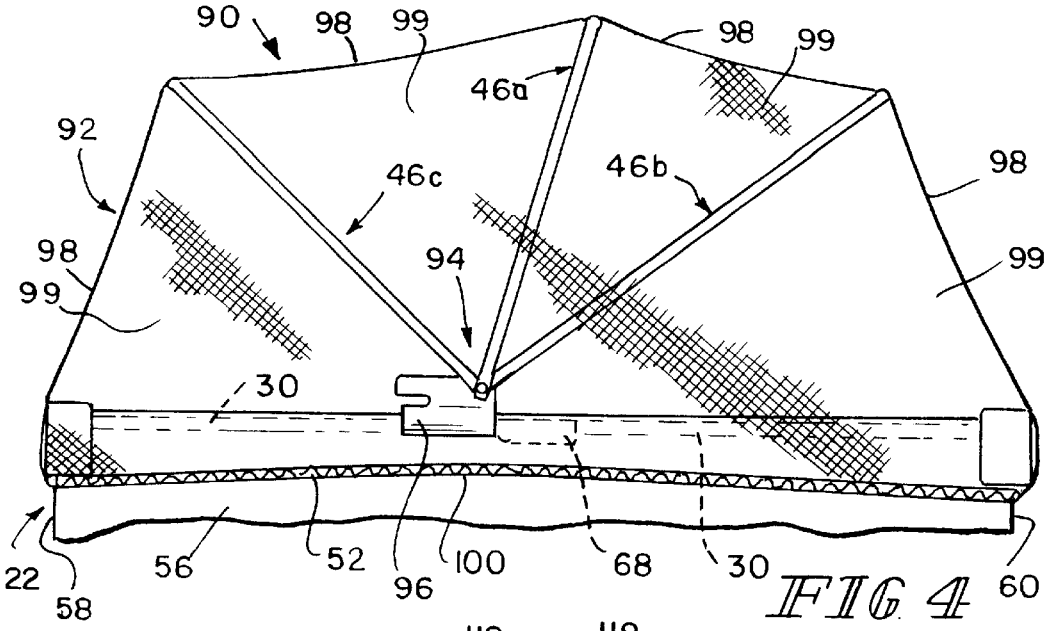
FIG. 4 is a side elevation view similar to FIG. 3 of a second embodiment of a tall playyard canopy in accordance with the present invention showing the playyard canopy having three U-shaped frame members hingedly coupled to one of a pair of spaced-apart mounting brackets and the three U-shaped frame members in an opened playyard-covering configuration fanned out across the top of the playyard in a generally even arrangement.

A second embodiment of a tall playyard canopy 90 in accordance with the present invention includes a cloth cover 92 similar to that of playyard canopy 20 and a canopy frame 94 having three U-shaped frame members 46*a,* 46*b,* 46*c* hingedly coupled to a pair of spaced-apart mounting brackets 96 which are similar to mounting brackets 28 of playyard canopy 20, as shown in FIG. 4. U-shaped frame members 46*a–c* can be folded between an opened playyard-covering configuration fanned out across open top 34 of playyard 22 and a collapsed storage configuration having U-shaped frame members 46*a–c* adjacent to one another.

Cloth cover 92 includes a top panel 98 having three spaced-apart transversely-extending sleeves (not shown) and a pair of spaced-apart side panels 99 extending downwardly from top panel 98 to side panels 56 of playyard 22 when canopy 90 is in the opened playyard-covering configuration. A cross strut (not shown) of each frame member 46*a–c* is received within a corresponding sleeve so that U-shaped frame members 46*a–c* are connected to top panel 98.

An elastic band 52 is attached to a bottom edge 100 of cloth cover 92, as was the case with playyard canopy 20. Elastic band 52 can contract against side panels 56 and against first and second end panels 58, 60 of playyard 22 to firmly secure bottom edge 100 of cloth cover 92 against playyard 22 so that cloth cover 92 completely encloses open top 34 of playyard 22. Elastic band 52 cooperates with cloth cover 92 to hold U-shaped frame members 46*a–c* in the opened playyard-covering configuration fanned out over open top 34 of playyard 22.

Figure 5:
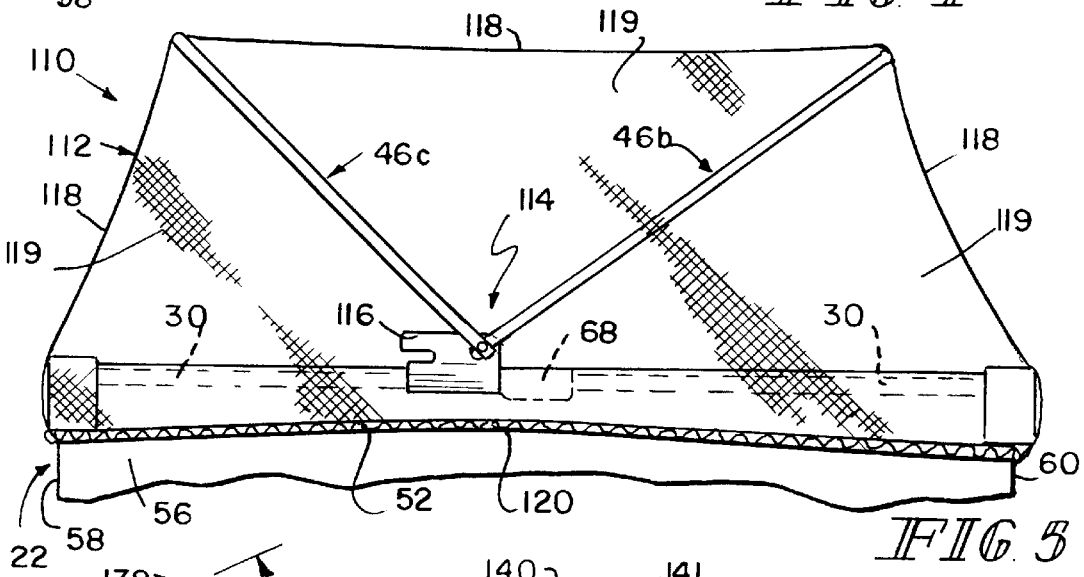
FIG. 5 is a side elevation view similar to FIG. 4 of a third embodiment of a tall playyard canopy in accordance with the present invention showing the playyard canopy having two U-shaped frame members hingedly coupled to one of a pair of spaced-apart mounting brackets and the two U-shaped frame members in an opened playyard-covering configuration fanned out across the top of the playyard in a generally even arrangement.

A third embodiment of a tall playyard canopy 110 in accordance with the present invention includes a cloth cover 112 similar to that of playyard canopy 90 and a canopy frame 114 having two U-shaped frame members 46*b,* 46*c* hingedly coupled to a pair of spaced-apart mounting brackets 116 which are similar to mounting brackets 96 of playyard canopy 90, as shown in FIG. 5. U-shaped frame members 46*b,* 46*c* can be folded between an opened playyard-covering configuration fanned out across open top 34 of playyard 22 and a collapsed storage configuration having U-shaped frame members 46*b,* 46*c* adjacent to one another.

Cloth cover 112 includes a top panel 118 having two spaced-apart transversely-extending sleeves (not shown) and a pair of spaced-apart side panels 119 extending downwardly from top panel 118 to side panels 56 of playyard 22 when canopy 110 is in the opened playyard-covering configuration. A cross strut (not shown) of each frame member 46*b,* 46*c* is received within a corresponding sleeve so that U-shaped frame members 46*b,* 46*c* are connected to top panel 118.

An elastic band 52 is attached to a bottom edge 120 of cloth cover 112, as was the case with playyard canopy 90. Elastic band 52 can contract against side panels 56 and against first and second end panels 58, 60 of playyard 22 to firmly secure bottom edge 120 of cloth cover 112 against playyard 22 so that cloth cover 112 completely encloses open top 34 of playyard 22. Elastic band 52 cooperates with cloth cover 112 to hold U-shaped frame members 46*b,* 46*c* in the opened playyard-covering configuration fanned out over open top 34 of playyard 22.

Figure 6:
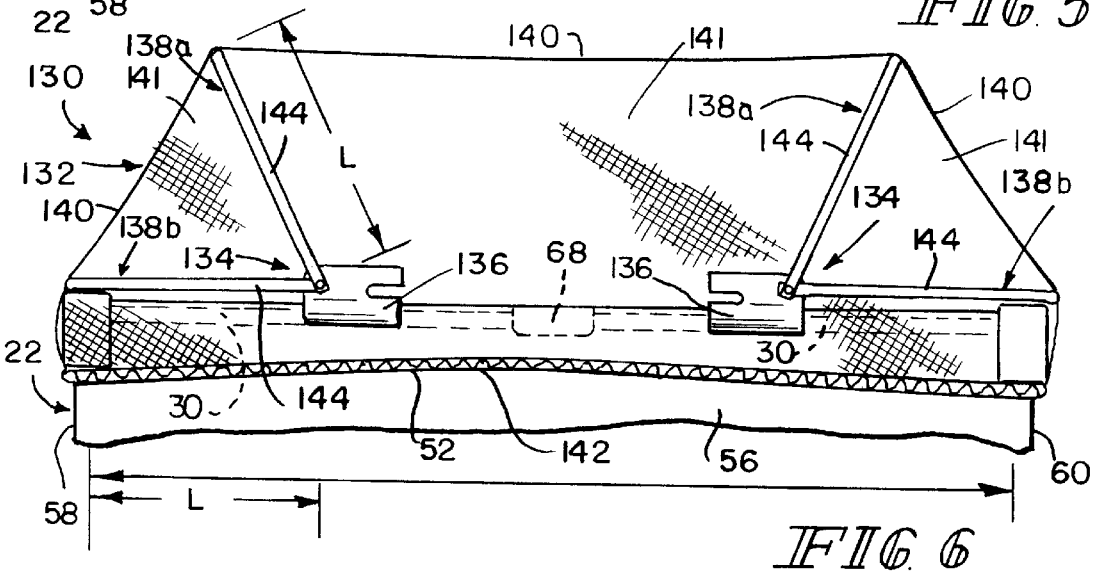
FIG. 6 is a side elevation view similar to FIG. 5 of a first embodiment of a "short" playyard canopy in accordance with the present invention showing the playyard canopy having two pairs of spaced-apart mounting brackets, two U-shaped frame members hingedly coupled to each pair of spaced-apart mounting brackets, and the four U-shaped frame members in an opened playyard-covering configuration fanned out across the top of the playyard.

A first embodiment of a "short" playyard canopy 130 in accordance with the present invention includes a cloth cover 132 and two spaced-apart canopy frames 134, as shown in FIG. 6. Each canopy frame 134 includes a pair of spaced-apart mounting brackets 136 and two U-shaped frame members 138*a,* 138*b* hingedly coupled to each pair of spaced-apart mounting brackets 136. Both sets of U-shaped frame members 138*a,* 138*b* can be folded between an opened playyard-covering configuration fanned out across a respective end of open top 34 of playyard 22 and a collapsed storage configuration having respective U-shaped frame members 138*a,* 138*b* adjacent to one another.

Cloth cover 132 includes a top panel 140 having four spaced-apart transversely-extending sleeves (not shown) and a pair of spaced-apart side panels 141 extending downwardly from top panel 140 to side panels 56 of playyard 22 when canopy 130 is in the opened playyard-covering configuration. A cross strut (not shown) of frame members 138*a,* 138*b* of each canopy frame 134 is received within a corresponding sleeve so that U-shaped frame members 138*a,* 138*b* are connected to top panel 140.

An elastic band 52 is attached to a bottom edge 142 of cloth cover 132, as was the case with playyard canopy 110. Elastic band 52 can contract against side panels 56 and against first and second end panels 58, 60 of playyard 22 to firmly secure bottom edge 142 of cloth cover 132 against playyard 22 so that cloth cover 132 completely encloses open top 34 of playyard 22. Elastic band 52 cooperates with cloth cover 132 to hold U-shaped frame members 138*a,* 138*b* in the opened playyard-covering configuration fanned out over the ends of open top 34 of playyard 22.

Each U-shaped frame member 138*a,* 138*b* includes a side strut 144 having a length "L", as shown in FIG. 6. Playyard 22 includes a removable mattress pad 146 with four articulated sections 148*a,* 148*b,* 148*c,* 148*d,* as shown best in FIG. 14. Playyard 22 can be folded from the opened playyard configuration through a partially collapsed configuration, shown in FIG. 15, to the collapsed storage configuration, shown in FIG. 16, and mattress pad 146 can be folded around collapsed playyard 22 and fastened together to provide a box-like carrying structure, as shown in FIG. 16. Each articulated section 148*a–d* of mattress pad 146 has a width "W", as shown in FIG. 1. Length L is approximately equal to width W thus allowing playyard canopy 130 to be stored in a pouch 172 attached to articulated section 148*b* of mattress pad 146 when playyard canopy 130 is in the collapsed storage configuration, as shown in FIGS. 14–16 (in phantom).

Pouch 172 covers substantially all of articulated section 148*b* and a zipper 173 is provided for opening and closing pouch 172 so that canopy 130 can be inserted and removed from pouch 172. An additional pouch 174 having a zipper 175 for opening and closing pouch 174 is attached to articulated section 148*c* and objects (not shown) can be inserted into pouch 174 and carried along with collapsed playyard 22.

Figure 14:
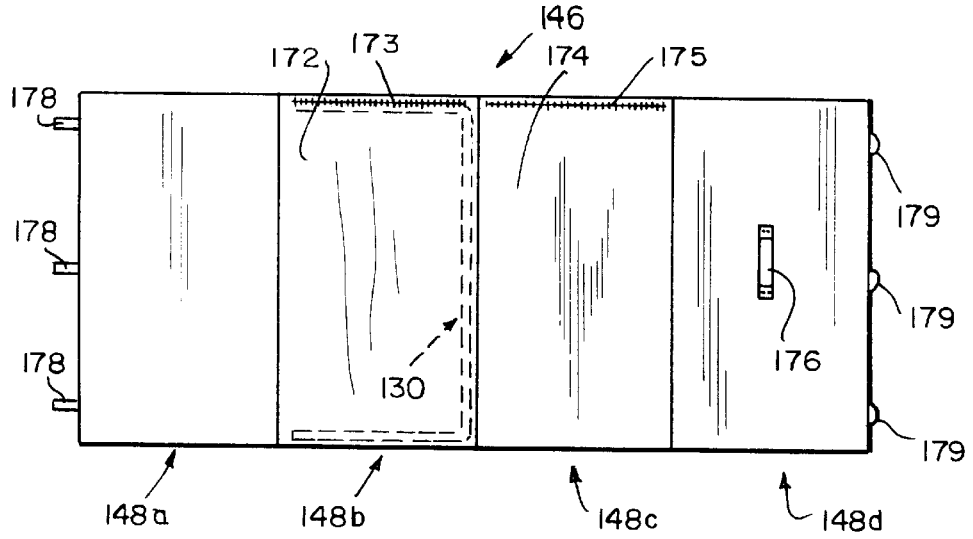
FIG. 14 is a bottom plan view of a mattress pad of the playyard of FIG. 10 showing the mattress pad having four longitudinally-spaced articulated sections that allow the mattress pad to be folded around the playyard when the playyard is folded to a collapsed storage configuration, one of the articulated sections having a handle that can be grasped to carry the mattress pad along with the collapsed playyard, another of the articulated sections having a zippered pouch in which objects can be carried along with the playyard, and yet another of the articulated sections having a zippered pouch in which the collapsed playyard canopy (in phantom) can be stored and carried along with the playyard.
Figure 15:
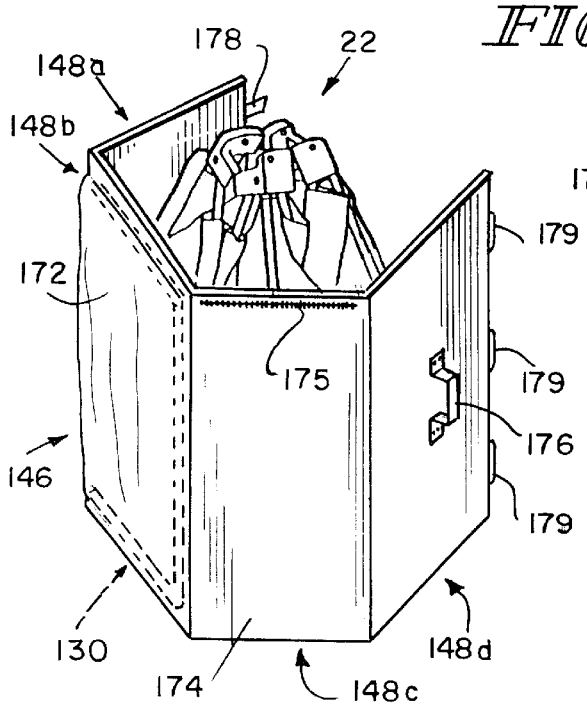
FIG. 15 is a perspective view of the playyard of FIG. 10 showing the playyard in a partially collapsed configuration, the mattress pad removed from the playyard and substantially encompassing the partially collapsed playyard, and the collapsed playyard canopy (in phantom) stored inside one of the zippered pouches.

Mattress pad 146 includes three spaced-apart hook and loop fastener tabs 178 mounted to articulated section 148*a* and three spaced-apart hook and loop fastener pads 179 mounted to articulated section 148*d,* as shown best in FIG. 14. Tabs 178 can fasten to respective pads 179 so that articulated sections 148*a–b* of mattress pad 146 are held together to form the box-like carrying structure shown in FIG. 16. In addition, a handle 176 is attached to articulated section 148*d,* as shown in FIGS. 14 and 15. Handle 176 can be grasped to carry collapsed playyard 22 when mattress pad 146 is fastened together to from the box-like carrying structure.

After playyard 22 has been collapsed and mattress pad 146 has been fastened to provide the box-like carrying structure, playyard 22 and mattress pad 146 can be placed inside a carrying bag (not shown). The carrying bag can be closed so that collapsed playyard 22 is prevented from falling out of the open ends of folded mattress pad 146 allowing collapsed playyard 22 and mattress pad 146 to be tipped from the vertical orientation, shown in FIG. 16, to a horizontal orientation (not shown) and carried in the horizontal orientation. The carrying bag includes an opening through which handle 176 extends so that handle 176 can be grasped to carry playyard 22, mattress pad 146, and playyard canopy 130.

Figure 7:
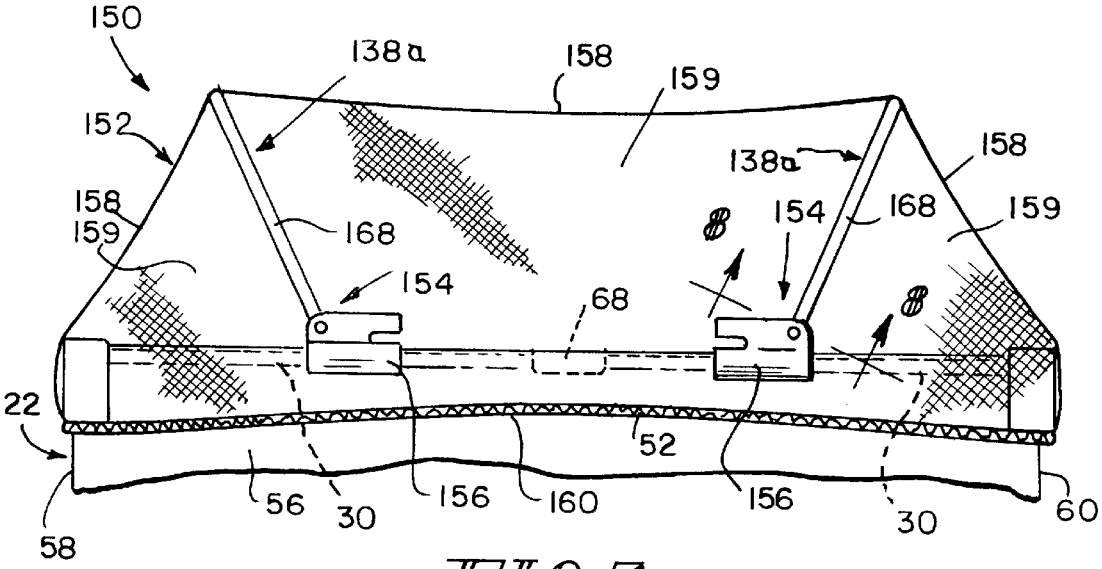
FIG. 7 is a side elevation view similar to FIG. 6 of a second embodiment of a short playyard canopy in accordance with the present invention showing the playyard canopy having two pairs of spaced-apart mounting brackets, a single U-shaped frame member hingedly coupled to each pair of spaced-apart mounting brackets, and the two U-shaped frame members in an opened playyard-covering configuration fanned out across the top of the playyard.

A second embodiment of a short playyard canopy 150 in accordance with the present invention includes a cloth cover 152 and two spaced-apart canopy frames 154, as shown in FIG. 7. Each canopy frame 154 includes a pair of spaced-apart mounting brackets 156 and a U-shaped frame member 138*a* hingedly coupled to each pair of spaced-apart mounting brackets 156. Both U-shaped frame members 138*a* can be folded between an opened playyard-covering configuration extending above a respective end of open top 34 of playyard 22 and a collapsed storage configuration having U-shaped frame members 138*a* adjacent to respective mounting brackets 156.

Cloth cover 152 includes a top panel 158 having two spaced-apart transversely-extending sleeves (not shown) and a pair of spaced-apart side panels 159 extending downwardly from top panel 158 to side panels 56 of playyard 22 when canopy 150 is in the opened playyard-covering configuration. A cross strut (not shown) of each frame member 138*a* is received within a corresponding sleeve so that U-shaped frame members 138*a* are connected to top panel 158.

An elastic band 52 is attached to a bottom edge 160 of cloth cover 152, as was the case with playyard canopy 130.

Elastic band 52 can contract against side panels 56 and against first and second end panels 58, 60 of playyard 22 to firmly secure bottom edge 160 of cloth cover 152 against playyard 22 so that cloth cover 152 completely encloses open top 34 of playyard 22. Elastic band 52 cooperates with cloth cover 152 to hold U-shaped frame members 138*a* in the opened playyard-covering configuration extending above the ends of open top 34 of playyard 22.

Figure 8:
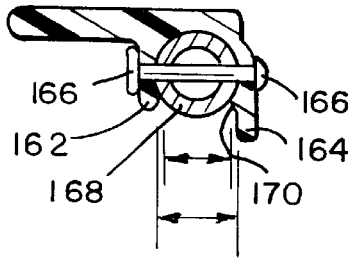
FIG. 8 is a cross-sectional view of one of the mounting brackets of the playyard canopy of FIG. 7 taken along line 8—8 of FIG. 7 showing the U-shaped frame member positioned to lie between inner and outer flanges formed in the mounting bracket, a pivot pin coupling the U-shaped frame member to the inner and outer flanges, and the outer flange of the mounting bracket including a detent that locks the U-shaped frame member in the opened playyard-covering configuration.

Each mounting bracket 156 includes an inner flange 162, an outer flange 164, and a pivot pin 166 connecting a side strut 168 of each U-shaped frame member 138*a* to inner and outer flanges 162, 164, as shown in FIG. 8. Outer flange 164 of each mounting bracket 156 includes an inwardly-protruding detent 170 that locks respective U-shaped frame members 138*a* in the opened playyard-covering configuration, as also shown in FIG. 8.

Figure 9:
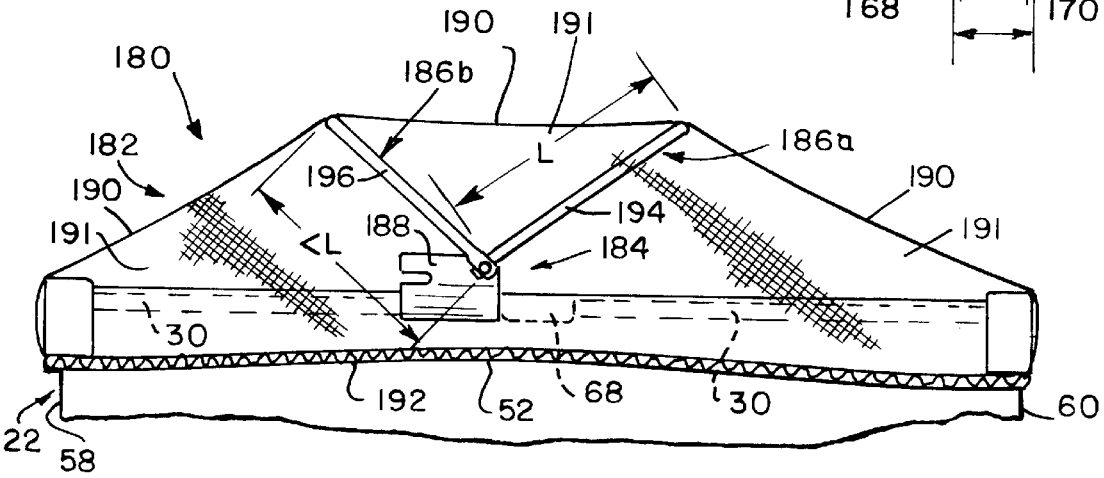
FIG. 9 is a side elevation view similar to FIG. 7 of a third embodiment of a short playyard canopy in accordance with the present invention showing the playyard canopy having two U-shaped frame members hingedly coupled to one of a pair of spaced-apart mounting brackets and the two U-shaped frame members in an opened playyard-covering configuration fanned out across the top of the playyard in a generally even arrangement.

A third embodiment of a short playyard canopy 180 in accordance with the present invention includes a cloth cover 182 similar to that of playyard canopy 150 and a canopy frame 184 having two U-shaped frame members 186*a,* 186*b* hingedly coupled to a pair of spaced-apart mounting brackets 188, as shown in FIG. 9. U-shaped frame members 186*a,* 186*b* can be folded between an opened playyard-covering configuration fanned out across open top 34 of playyard 22 and a collapsed storage configuration having U-shaped frame members 186*a,* 186*b* adjacent to one another.

U-shaped frame member 186*a* includes a side strut 194 having a length "L", as shown in FIG. 9, so that playyard canopy 180 can be stored in pouch 172 attached to articulated section 148*b* of mattress pad 146 when playyard canopy 180 is in the collapsed storage configuration. U-shaped frame member 186*b* includes a side strut 196 having a length that is less than L to compensate for the off-center mounting of mounting brackets 188 due to the position of latch and latch-release mechanisms 68 of playyard 22 so that cloth cover 182 assumes a generally symmetrical shape when playyard canopy 20 is in the opened playyard-covering configuration covering open top 34 of playyard 22, as shown in FIG. 9.

Cloth cover 182 includes a top panel 190 having two spaced-apart transversely-extending sleeves (not shown) and a pair of spaced-apart side panels 191 extending downwardly from top panel 190 to side panels 56 of playyard 22 when canopy 180 is in the opened playyard-covering configuration. A cross strut (not shown) of each frame member 186*a,* 186*b* is received within a corresponding sleeve so that U-shaped frame members 186*a,* 186*b* are connected to top panel 190.

An elastic band 52 is attached to a bottom edge 192 of cloth cover 182, as was the case with playyard canopy 150. Elastic band 52 can contract against side panels 56 and against first and second end panels 58, 60 of playyard 22 to firmly secure bottom edge 192 of cloth cover 182 against playyard 22 so that cloth cover 182 completely encloses open top 34 of playyard 22. Elastic band 52 cooperates with cloth cover 182 to hold U-shaped frame members 186*a,* 186*b* in the opened playyard-covering configuration fanned out over open top 34 of playyard 22.

Figure 10:
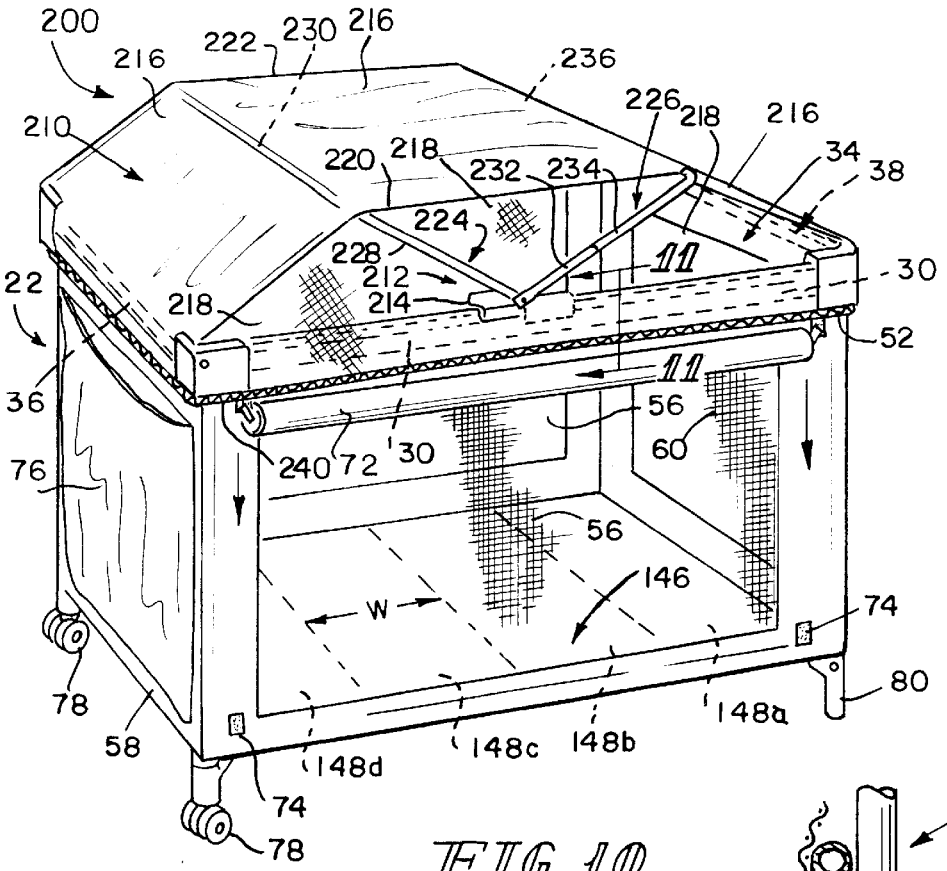
FIG. 10 is a perspective view of a fourth embodiment of a short playyard canopy in accordance with the present invention showing the playyard canopy in an opened playyard-covering configuration mounted on the top side rails of the playyard and positioned to lie above the top opening of the playyard, the playyard canopy including a canopy frame having a first U-shaped frame member and a second U-shaped frame member, the first and second U-shaped frame members hingedly coupled to a single pair of spaced-apart mounting brackets, and the U-shaped frame members fanned out over the top of the playyard to which the playyard canopy is mounted.
Figure 13:
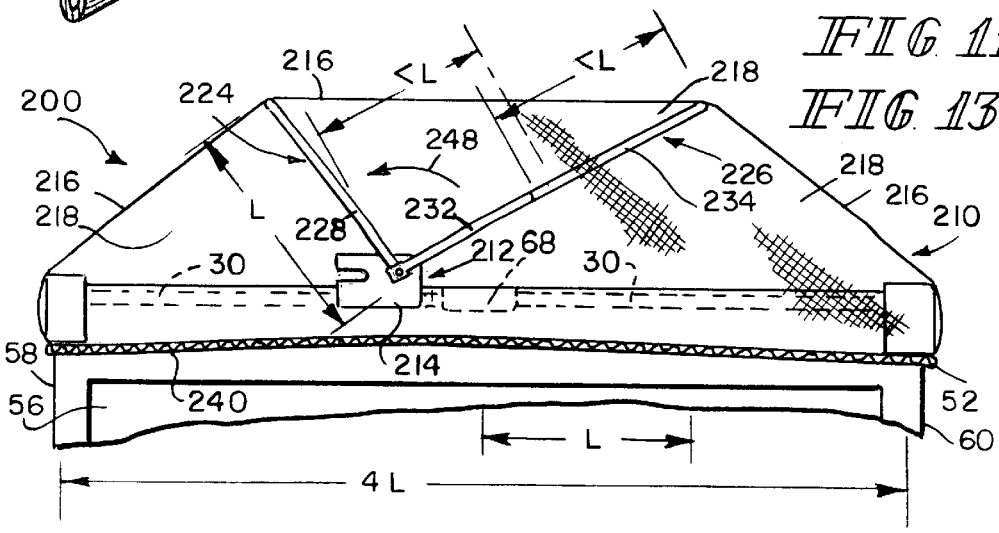
FIG. 13 is a side elevation view of the playyard canopy of FIG. 10 showing the first and second U-shaped frame members in an opened playyard-covering configuration fanned out across the top of the playyard in a generally even arrangement, and a side strut of the first U-shaped frame member being shorter than the coupled upper and lower side strut portions of the second U-shaped frame member.

A fourth embodiment of a short playyard canopy 200 is provided for covering a playyard 22, as shown in FIGS. 10 and 13. Playyard canopy 200 includes a cloth cover 210 and a collapsible canopy frame 212 supporting cloth cover 210, as shown best in FIG. 10. Frame 212 of canopy 200 includes a pair of spaced-apart mounting brackets 214 that snap onto respective top side rails 30 of playyard 22 so that playyard canopy 200 can be attached to and detached from playyard 22.

Cloth cover 210 includes a top panel 216 that is positioned to lie above open top 34 of playyard 22 and that extends longitudinally between first and second top end rails 36, 38 of playyard 22 when playyard canopy 200 is in an opened playyard-covering configuration, as shown in FIGS. 10 and 13. Cloth cover 210 also includes two side panels 218 which extend downwardly from first and second side edges 220, 222 of top panel 216 to lateral side panels 56 of playyard 22, as shown in FIG. 10.

Top panel 216 of cloth cover 210 is made from an opaque solid material so that sunlight and other objects are blocked by top panel 210 from entering playyard 22. In addition, side panels 218 of cloth cover 210 are made from a generally transparent netting material so that a person attending to a child which is placed in playyard 22 can see into playyard 22 to observe the activities of the child and so that the child can see out of playyard 22 to observe the surrounding environment. The netting material of side panels 218 also prevents bugs and other objects from entering playyard 22.

Figure 12:
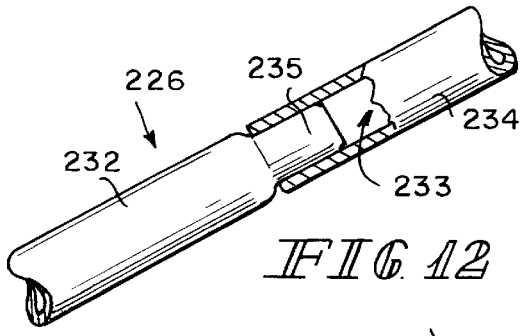
FIG. 12 is a side elevation view of the second U-shaped frame member of FIG. 10 with portions broken away showing an upper side strut portion of second U-shaped frame member formed to include an interior region and an end of a lower side strut portion received within the interior region so that the upper and lower side strut portions of the second U-shaped frame are held together in an in-line arrangement.

Canopy frame 212 of playyard canopy 200 includes a first U-shaped frame member 224 and a second U-shaped frame member 226 connecting mounting brackets 214 together, as shown in FIG. 10. First U-shaped frame member 224 includes a pair of spaced-apart side struts 228 having a length "L", as shown in FIG. 13, and a cross strut 230 extending transversely therebetween. Second U-shaped frame member 226 includes a pair of spaced-apart lower side strut portions 232 each of which is coupled to respective mounting brackets 214 and a pair of spaced-apart upper side strut portions 234 that couple to respective lower side strut portions 232, as shown in FIGS. 10, 12, and 13. A cross strut 236 extends between upper side strut portions 234.

Each upper side strut portion 234 is formed to include an interior region 233 and each lower side strut portion 232 includes an end 235 that is received by interior region 233 so that upper and lower side strut portions 234, 232 are held together in an inline arrangement, as shown in FIG. 12. Thus, upper and lower side strut portions 234, 232 and cross strut 230 cooperate to form second U-shaped frame member 226 when ends 235 of lower side strut portions 232 are inserted into interior regions 233 of upper side strut portions 234.

When upper side strut portions 234 are coupled to lower side strut portions 232, the length of coupled side strut portions 232, 234 is greater than L in order to compensate for the off-center mounting of mounting brackets 214 due to the position of latch and latch-release mechanism 68 of playyard 22 so that cloth cover 210 assumes a generally symmetrical shape when playyard canopy 200 is in the opened playyard-covering configuration, as shown in FIG. 13. Each upper and lower side strut portion 232, 234 has a length that is less than L so that when upper side strut portions 234 are decoupled from lower side strut portions 232, upper and lower side strut portions 232, 234 can fit into pouch 172 allowing playyard canopy 200 to be stored in pouch 172 and carried along with collapsed playyard 22.

Side struts 228 of first U-shaped frame member 224 and lower side strut portions 232 of second U-shaped frame member 226 each have an end hingedly connected to one of respective mounting brackets 214 for pivoting movement about a common horizontal hinge axis 238. Top panel 216 includes two spaced-apart transversely-extending sleeves (not shown) and cross struts 230, 236 of first and second U-shaped frame members 224, 226 are received within a corresponding sleeve so that first and second U-shaped frame members 224, 226 are connected to top panel 216.

When canopy 200 is in the opened playyard-covering configuration, first and second U-shaped frame members 224, 226 angle upwardly away from mounting brackets 214 so that first and second U-shaped frame members 224, 226 are generally evenly fanned out from mounting brackets 214 across open top 34 of playyard 22. In addition, cloth cover 210 is pulled taut between first and second U-shaped frame members 224, 226 when canopy 200 is in the opened playyard-covering configuration.

Figure 11:
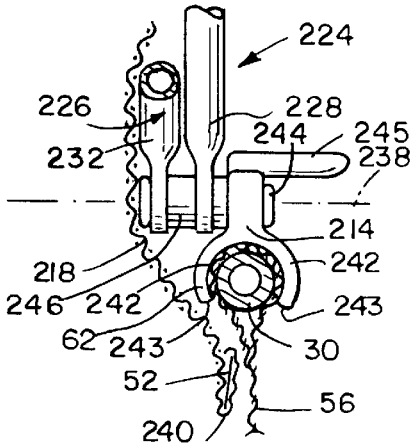
FIG. 11 is a cross-sectional view of one of the mounting brackets of the playyard canopy taken along line 11—11 of FIG. 10 showing the mounting bracket snapped onto one of the side rails of the playyard, a horizontal hinge pin extending outwardly from the mounting bracket, an end of each of the two U-shaped frame members mounted on the hinge pin for pivoting movement about a transverse horizontal hinge axis, and a spacer mounted on the hinge pin between the ends of the U-shaped frame members.

An elastic band 52 is attached to a bottom edge 240 of cloth cover 210, as shown in FIGS. 10, 11, and 13. Elastic band 52 can be stretched around the perimeter of playyard 22 adjacent to and below first and second top end rails 36, 38 and adjacent to and below top side rails 30 of playyard 22. Bottom edge 240 of cloth cover 210 can encompass playyard 22 so that elastic band 52 can contract against side panels 56 and against first and second end panels 58, 60 of playyard 22 to firmly secure bottom edge 240 of cloth cover 210 firmly against playyard 22. Thus, cloth cover 210 completely encloses open top 34 of playyard 22. Elastic band 52 cooperates with cloth cover 210 to hold first and second U-shaped frame members 224, 226 in the opened playyard-covering configuration fanned out over open top 34 of playyard 22.

Each mounting bracket 214 of canopy frame 212 is formed to include a pair of downwardly extending curved flanges 242, as shown in FIG. 11. Curved flanges 242 have bottom edges 243 that elastically deform outwardly away from one another when canopy 200 is mounted to top side rails 30 of playyard 22 allowing mounting brackets 214 to snap onto side rails 30. After mounting brackets 28 are snapped onto side rails 30, bottom edges 243 return inwardly so that curved flanges 242 snugly grip side rails 30 to firmly hold canopy 200 onto playyard 22. Each mounting bracket 214 also includes a plate 245 which can be engaged to snap mounting bracket 214 onto and off of side rails 30 of playyard 22.

A horizontal hinge pin 244 extends outwardly from each mounting bracket 214 above curved flanges 242 and the ends of side struts 228 and lower side strut portions 232 of first and second U-shaped frame members 224, 226 are coupled to one of respective hinge pins 244. Hinge pins 244 of mounting brackets 214 are aligned to define common hinge axis 238 about which both U-shaped frame members 224, 226 pivot. The ends of side struts 228 and lower side strut portions 232 that couple to respective hinge pins 244 are flattened. A spacer 246 is mounted on each hinge pin 244 between the flattened end of side strut 228 and lower side strut portion 232, as shown in FIG. 11. Hinge pins 244 cooperate with U-shaped frame members 224, 226 to allow canopy 200 to fold between the opened playyard-covering configuration and a collapsed storage configuration while canopy 200 is mounted to playyard 22.

When a portion of elastic band 52 is pulled away from side rails 30 and second end rail 38, second U-shaped frame member 226 can pivot about horizontal hinge axis 238 toward first U-shaped frame member 224 in the direction indicated by arrow 248, as shown in FIG. 13, allowing playyard canopy 200 to be folded from the opened playyard-covering configuration to the collapsed storage configuration. When playyard canopy 200 is in the collapsed storage configuration, cross struts 230, 236 are adjacent to one another, side struts 228 of first U-shaped frame member 224 are adjacent to respective upper and lower side strut portions 234, 232 of second U-shaped frame member 226, and cloth cover 210 is bunched together and loosely hangs between first and second U-shaped frame members 224, 226.

Thus, when playyard canopy 200 is mounted onto playyard 22, playyard canopy 200 can be folded from the opened playyard-covering configuration to the collapsed storage configuration allowing the child attendant to have access to playyard 22 so that the child can be placed into or removed from playyard 22 through open top 34. After the child has been placed into playyard 22, the child attendant can then unfold playyard canopy 200 from the collapsed storage configuration back to the opened playyard-covering configuration to cover playyard 22 and shield the child from sunlight and other objects. Alternatively, the child attendant can easily detach playyard canopy 200 from playyard 22 while playyard canopy 200 is in the collapsed storage configuration. After being detached from playyard 22, upper side strut portions 234 can be decoupled from lower side strut portions 232 allowing playyard canopy 200 to be compactly stored within pouch 172.

Although the invention has been described in detail with reference to certain preferred embodiments, variations and modifications exist within the scope and spirit of the invention as described and as defined in the following claims.

We claim:

1. A combination playyard and canopy assembly comprising a playyard including a top frame, tho top frame having first and second side rails and first and second end rails extending between the first and second side rails, the first and second side rails and first and second end rails defining an opening, and a canopy including a mounting member, at least two frame members, and a cover, the mounting member being attached to or detached from the top frame, the at least two frame members being pivotably coupled to the mounting member for movement about a common pivot axis, the cover being coupled to each of the frame members to extend between the at least two frame members, the frame members, being movable between an opened position fanned out over the opening defined by the top frame and a collapsed position folded together in side-by-side relation, the cover and at least two frame members extending over the opening when the at least two frame members are in the opened position.

2. The combination playyard and canopy assembly of claim 1, wherein the mounting member attaches to one of the side rails of the top frame, the mounting member is spaced apart from one of the end rails by a first distance, and the mounting member is spaced apart from the other of the end rails by a second distance that is larger than the first distance.

3. The combination playyard and canopy assembly of claim 1, wherein the at least two frame members includes a first frame member having a portion adjacent to one of the end rails of the top frame when the frame members are in the opened position and the at least two frame members includes a second frame member having a portion adjacent to another of the end rails of the top frame when the frame members are in the opened position.

4. The combination playyard and canopy assembly of claim 1, further comprising a second mounting member and wherein the at least two frame members each include a pair of side struts coupled to the respective mounting members and a cross strut coupling the side struts together so that each frame member is substantially U-shaped.

5. The combination playyard and canopy assembly of claim 4, wherein the cover is pulled taut between the cross struts when the frame members are in the opened position.

6. The combination playyard and canopy assembly of claim 4, wherein the cover includes a top panel coupled to each of the cross struts and a pair of side panels extending downwardly from the top panel adjacent to respective side struts.

7. The combination playyard and canopy assembly of claim 4, wherein the side struts are inclined with respect to the top frame when the frame members are in the opened position and the side struts are substantially parallel with the top frame when the frame members are in the collapsed position.

8. The combination playyard and canopy assembly of claim 4, wherein each side strut of the pair of side struts of one of the frame members has a length that is different than the length of each side strut of the pair of side struts of another of the frame members.

9. The combination playyard and canopy assembly of claim 1, wherein at least one of the frame members is a two-piece frame member having a lower portion that couples to the mounting member and an upper portion that couples to the lower portion.

10. The combination playyard and canopy assembly of claim 9, wherein another of the frame members includes a side strut having a first length, the lower portion of the two-piece frame member has a second length that is less than the first length, and the upper portion of the two-piece frame member includes a side strut having a third length that is less than the first length.

11. The combination playyard and canopy assembly of claim 10, wherein the end rails of the playyard are spaced apart by a longitudinal distance and the first length is about one-fourth of the longitudinal distance.

12. The combination playyard and canopy assembly of claim 1, wherein each of the frame members includes a side strut having a first length, the end rails of the playyard are spaced apart by a longitudinal distance, and the first length is about one-fourth of the longitudinal distance.

13. The combination playyard and canopy assembly of claim 1, wherein the cover includes a top panel having end edges that are adjacent to respective end rails of the top frame and a middle portion extending between the end edges and bridging the opening of the playyard between the end rails.

14. The combination playyard and canopy assembly of claim 1, wherein the cover is made of a pliable material, the cover is bunched together when the frame members are in the collapsed position, and the cover extends tautly between the frame members when the frame members are in the opened position.

15. The combination playyard and canopy assembly of claim 1, wherein the mounting member includes resilient members configured to snap onto and snap off of the top frame of the playyard.

16. The combination playyard and canopy assembly of claim 15, wherein the side rails of the top frame are round in cross section and the resilient members of the mounting member are arcuate in cross section.

17. The combination playyard and canopy assembly of claim 15, wherein the mounting member includes a plate having an upwardly facing surface and application of a downward force to the upwardly facing surface causes the mounting member to snap onto the top frame.

18. The combination playyard and canopy assembly of claim 15, wherein the mounting member includes a plate having a downwardly facing surface and application of an upward force to the downwardly facing surface causes the mounting member to snap off of the top frame.

19. The combination playyard and canopy assembly of claim 1, wherein the cover includes a bottom perimetral edge that encompasses the top frame of the playyard when the frame members are in the opened position.

20. The combination playyard and canopy assembly of claim 19, wherein the cover includes an elastic band at the bottom perimetral edge, the playyard includes side panels extending downwardly from the top frame, and the elastic band contracts against the side panels of the playyard.

21. The combination playyard and canopy assembly of claim 19, further comprising at least one fastener including one portion coupled to the top cover and another portion coupled to the playyard and the first portion cooperates with the second portion to secure the top cover of the canopy to the playyard.

22. The combination playyard and canopy assembly of claim 21, wherein the at least one fastener is a snap.

23. The combination playyard and canopy assembly of claim 21, wherein the at least one fastener is a hook and loop fastener.

24. A combination playyard and canopy assembly comprising a playyard including a top frame, the top frame having first and second side rails and first and second end rail extending between the first and second side rails, the first and second side rail and first and second end rails defining an opening, and a canopy including a mounting clip, at least one frame member, and a cover, the at least one frame member being pivotably coupled to the mounting clip, the cover being attached to the at least one canopy frame member, the at least one frame member being pivotable relative to the mounting clip between a first position in which the cover extends over the opening and a second position in which the cover is moved away from the opening to allow access to the interior region of the playyard, and the mounting clip including deformable members snapped onto the top frame to mount the canopy to the top frame.

25. The combination playyard and canopy assembly of claim 24, wherein the top frame includes a rail having a substantially round cross section, the deformable members of the mounting clip are flanges with arcuate cross sections, and the flanges grip the rail to mount the canopy to the playyard.

26. The combination playyard and canopy assembly of claim 25, further comprising a pivot pin extending from the mounting clip and the at least one frame member being mounted to the pivot pin.

27. The combination playyard and canopy assembly of claim 26, wherein the pivot pin is positioned to lie above the flanges.

28. The combination playyard and canopy assembly of claim 26, wherein the pivot pin is perpendicular to the rail.

29. The combination playyard and canopy assembly of claim 24, further comprising a pivot pin extending from the mounting clip and the at least one frame member being mounted to the pivot pin.

30. The combination playyard and canopy assembly of claim 29, wherein the pivot pin is positioned to lie above the deformable members.

31. The combination playyard and canopy assembly of claim 29, wherein the mounting clip includes a plate having an upwardly facing surface and application of a downward force to the upwardly facing surface causes the mounting clip to snap onto the top frame.

32. The combination playyard and canopy assembly of claim 31, wherein the mounting clip includes a body to which the deformable members are appended, the pivot pin extends away from the body in a first direction, and the plate extends away from the body in a second direction opposite to the first direction.

33. The combination playyard and canopy assembly of claim 29, wherein the mounting clip includes a plate having a downwardly facing surface and application of an upward force to the downwardly facing surface causes the mounting clip to snap off of the top frame.

34. The combination playyard and canopy assembly of claim 33, wherein the mounting clip includes a body to which the deformable members are appended, the pivot pin extends away from the body in a first direction, and the plate extends away from the body in a second direction opposite to the first direction.

35. A combination playyard and canopy assembly comprising a playyard including a top frame, the top frame having first and second side rails and first and second end rails extending between the first and second side rails, the first and second side rails and first and second end rails defining an opening, and a canopy including a cover, at least one mounting member, and at least one frame member, the cover having a bottom perimetral edge, the at least one mounting member being attached to the top frame to attach the canopy to the top frame, the at least one frame member being pivotably coupled to the at least one mounting member for pivoting movement between a first position in which the opening defined by the top frame is covered by the cover and a second position in which the opening defined by the top frame is uncovered, the bottom perimetral edge of the cover being attached to the first and second side rails and first and second end rails of the top frame so that the cover encompasses the entire top frame when the at least one frame member is in the first position.

36. The combination playyard and canopy assembly of claim 35, wherein the bottom edge of the cover includes a portion positioned to lie beneath the mounting member and beneath the at least one frame member.

37. The combination playyard and canopy assembly of claim 35, wherein cover includes an elastic band at the bottom perimetral edge and the elastic band contracts against the side walls of the playyard to secure the canopy to the playyard.

38. The combination playyard and canopy assembly of claim 35, further comprising at least one fastener including a first portion coupled to the cover and a second portion coupled to the playyard and the first portion cooperates with the second portion to secure the cover of the canopy to the playyard.

39. The combination playyard and canopy assembly of claim 38, wherein the at least one fastener is a snap.

40. The combination playyard and canopy assembly of claim 38, wherein the at least one fastener is a hook and loop fastener.

41. The combination playyard and canopy assembly of claim 38, wherein the first portion of the at least one fastener is coupled to the cover near the bottom edge thereof.

42. The combination playyard and canopy assembly of claim 41, wherein the second portion of the at least one fastener is coupled to one of the side walls of the playyard.

43. A combination playyard and canopy assembly comprising a playyard including a top frame and a latch-release mechanism, the top frame having first and second side rails and first and second end rails extending between the first and second side rails, the first and second side rails and first and second end rails defining an opening, each of the first and second side rails having a midpoint midway between the first and second end rails, and the latch-release mechanism being at the midpoint of the first and second side rails, and a canopy including a mounting member, at least two frame member, and a covers, the mounting member being attached to or detached from the top frame, the at least two frame members being pivotably coupled to the mounting member, the cover being coupled to each of the frame members and configured to extend therebetween, the frame members being movable between an opened position framed out over the opening defined by the top frame and a collapsed position folded together in side-by-side relation, the cover and at least two frame members extending over the opening when the at least two frame members are in the opened position, and the mounting member being attached to the top frame offset from the midpoint of the first and second side rails and spaced-apart from the latch-release mechanism.

44. A combination playyard and canopy assembly comprising a playyard including a top frame, the top frame having first and second side rails and first and second end rails extending between the first and second side rails, the first and second side rails and first and second end rails defining an opening, and the top frame having a top edge, and a canopy including a mounting member, at least two frame members, and a cover, the mounting member being attached to or detached from the top frame, the at least two frame members being pivotably coupled to the mounting member for movement about a common pivot axis, the cover having a bottom edge and being coupled to each of the frame members to extend between the at least two frame members, the frame members being movable between an opened position fanned out over the opening defined by the top frame and a collapsed position folded together in side-by-side relation, the cover and at least two frame members extending over the opening when the at least two frame members are in the opened position, and the bottom edge of the cover extending downwardly over the top edge of the top frame.

45. A combination playyard and canopy assembly comprising a playyard including a top frame, the top frame having first and second side rails and first and second end rails extending between the first and second side rails, the first and second side rails and first and second end rails defining an opening, and a canopy including a mounting clip, at least one frame member, and a cover, the at least one frame member being pivotably coupled to the mounting clip, the cover bring attached to the at least one canopy frame member, the at least one frame member being pivotable relative to the mounting clip between a first position in which the cover extends over the opening and a second position in which the cover is moved away from the opening to allow access to the interior region of the playyard, and the mounting clip including resilient members snapped onto the top frame to mount the canopy to the top frame.

46. A combination playyard and canopy assembly comprising a playyard including a frame having side rails and end rails arranged around a top opening of the playyard, a plurality of side walls coupled to the frame and arranged around an interior region of the playyard, a mattress pad in the interior region of the playyard, the mattress pad being removable from the interior region and having articulated sections, and a pouch coupled to one of the articulated sections, and a collapsible canopy including a cover, at least one mounting bracket being attached to the playyard to attach the cover to the playyard, and at least one frame member pivotably coupled to the at least one mounting bracket and extending upwardly from the at least one mounting bracket to support the cover over the opening of the playyard, the at least one frame member being configured to fit within the pouch when the canopy is in a collapsed position.

47. The assembly of claim 46, wherein the side rails of the playyard each include a pair of side rail segments coupled together by a hinge and latch assembly for pivoting movement about an axis that is positioned to lie substantially midway between the end rails, the at least one mounting member of the canopy is coupled to one of the side rails adjacent to the respective hinge and latch assembly, and the at least one frame member of the canopy pivots relative to the mounting member at a pivot axis that is substantially parallel with and offset from the axis of the side rail segments.

48. The assembly of claim 46, wherein the at least one frame member of the canopy includes a first frame member and a second frame member, the first frame member is sized differently that the second frame member, and both of the first and second frame members are configured to fit within the pouch of the playyard.

49. The assembly of claim 46, wherein the cover and mounting bracket are configured to fit within the canopy is a collapsed position.

50. The assembly of claim 46, wherein the playyard includes a handle coupled to one of the articulated sections and the handle is spaced apart from the pouch.

51. A combination playyard and canopy assembly comprising a playyard including a frame having side rails and end rails arranged around a top opening of the playyard, a plurality of side walls coupled to the frame and arranged around an interior region of the playyard, a mattress pad in the interior region of the playyard, the mattress pad being removable from the interior region and having articulated sections, and a pouch coupled to one of the articulated sections, and a collapsible canopy including a cover, a first pair of mounting members being attached to the side rails of the frame of the playyard, a second pair of mounting members spaced apart from the first pair of mounting members and configured to attach to the side rails of the frame of the playyard, a first frame member coupled to the first pair of mounting members and extending upwardly from the first pair of mounting members to support a first portion of the cover over the opening of the playyard, and a second frame member coupled to the second pair of mounting members and extending upwardly from the second pair of mounting members to support a second portion of the cover over the opening of the playyard, each of the first and second frame members being configured to fit within the pouch when the canopy is in a collapsed position.

52. The assembly of claim 51, wherein the first and second frame members are rigidly coupled to the respective first and second pair of mounting members.

53. The assembly of claim 51, wherein the first and second frame members are pivotably coupled to the respective first and second pair of mounting members.

54. The assembly of claim 51, wherein the cover and mounting bracket are configured to fit within the pouch when the canopy is in a collapsed position.

55. The assembly of claim 51, wherein the playyard includes a handle coupled to one of the articulated sections and the handle is spaced apart from the pouch.

* * * * *